United States Patent [19]

Wielezynski

[11] 4,265,734

[45] May 5, 1981

[54] METHOD FOR REGENERATION OF USED LUBRICANT OILS

[76] Inventor: Lech G. Wielezynski, "Le Bocage", St. Pierre es Champs 60850 St. Germer de Fly, France

[21] Appl. No.: 90,465

[22] Filed: Nov. 1, 1979

[51] Int. Cl.[3] ..... C10M 11/00

[52] U.S. Cl. ..... 208/180; 208/312

[58] Field of Search ..... 208/180, 251 R, 309, 208/311, 317; 196/14.52

[56] References Cited

U.S. PATENT DOCUMENTS

| | | | |
|---|---|---|---|
| 3,150,934 | 9/1964 | Hazard | 196/14.52 |
| 3,779,902 | 12/1973 | Mitchell et al. | 208/309 |
| 3,870,625 | 3/1975 | Wielezynski | 208/180 |

*Primary Examiner*—Brian E. Hearn

*Attorney, Agent, or Firm*—Thomas L. Cantrell; Joseph H. Schley

[57] ABSTRACT

The invention concerns improvements in the process of U.S. Pat. No. 3,870,625 for treating polluted lubricating oil. Previous to said treatment, the used lubricating oil is injected, preferably at a plurality of levels, into at least one reservoir containing liquid propane, where it is left for a time necessary for its dissolution and for its primary separation from the insoluble impurities.

7 Claims, 1 Drawing Figure

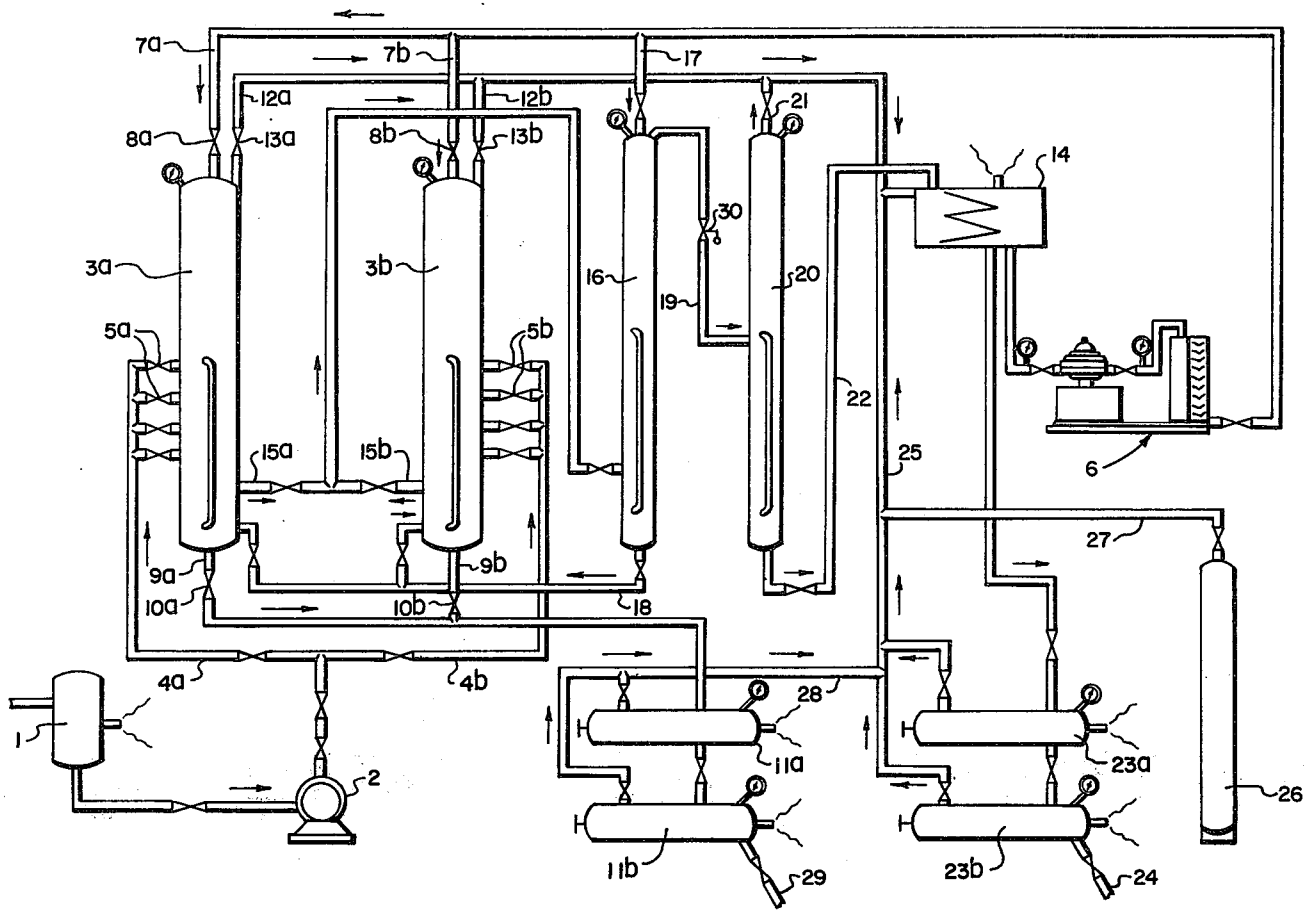
1
2
3a
3b
4a
4b
5a
5b
6
7a
7b
8a
8b
9a
9b
10a
10b
11a
11b
12a
12b
13a
13b
14
15a
15b
16
17
18
19
20
21
22
23a
23b
24
25
26
27
28
29
30

METHOD FOR REGENERATION OF USED LUBRICANT OILS

BACKGROUND OF THE INVENTION

My U.S. Pat. No. 3,870,625 relates to a process for the regeneration of used lubricating oil, consisting of spraying said oil in pulsed form at the top of a first column in which propane is introduced in a counterflow to said oil, then passing the mixture of oil, propane and oil dissolved in propane, successively into a plurality of columns disposed in series, at the top of one of which, at least, propane is introduced in pulsations counterflowing to said mixture, removing from the base of said columns the impurities which are there deposited by gravity, recovering from the last column the solution of oil in the liquid propane, and separating the oil, thus purified, from said liquid propane by vaporization of the latter.

In order to ensure a better contact between the liquid propane and the oil to be regenerated, mechanical vibrations are preferably imparted to said columns.

The vaporized propane, at the end of the treatment of the oil, is then liquified by compression, so as to be recycled into the high pressure circuit in liquid state.

My U.S. Pat. No. 3,870,625 also describes a device for the implementation of this process.

SUMMARY OF THE INVENTION

I have now discovered that the efficiency of the process of my U.S. Pat. No. 3,870,625 is considerably increased if before causing the used oil to circulate in a counterflow to the liquid propane, the said used oil is, first of all, sprayed into one or more reservoirs containing liquid propane, and if then this polluted oil lies for a necessary time in this/those reservoir/s so that it may mix with the liquid propane by being dissolved therein, that a considerable fraction of the insoluble impurities which it contains precipitates at the base of the reservoir, from which they may be discharged. The oil-propane mixture may then be treated as previously described in my U.S. Pat. No. 3,870,625.

The invention accordingly represents a method for the regeneration of used lubricating oil, by treatment with liquid propane in purifying columns, characterized in that, previous to treatment in accordance with my U.S. Pat. No. 3,870,625, the used lubricating oil is injected into at least one reservoir containing propane, and in which the oil in propane remains for a necessary period of time in this reservoir following which the oil-propane mixture is then treated as described in said patent, while the impurities precipitated in said reservoir are removed from the base thereof.

Preferably, the used oil is injected into the propane contained in this reservoir/s at a plurality of different levels.

DESCRIPTION OF THE DRAWING

The single FIGURE of the accompanying drawing is a simplified diagram illustrating one embodiment of the improvement according to the present invention of the process according to my U.S. Pat. No. 3,870,625.

DESCRIPTION OF A PREFERRED EMBODIMENT

In accordance with the present invention, a reservoir 1 of polluted and heated lubricating oil feeds, by means of a pump 2, two reservoirs 3*a* and 3*b* containing the liquid propane. The lines 4*a*, 4*b*, respectively connecting pump 2 to reservoirs 3*a* and 3*b*, emerge therein through four injectors, respectively 5*a* and 5*b*, disposed at different levels.

Reservoirs 3*a* and 3*b* are fed at their upper part with high pressure liquid propane, from a compressor 6 through lines 7*a*, 7*b* fitted with valves 8*a*, 8*b*. At the base of reservoirs 3*a*, 3*b* there is provided a line 9*a*, 9*b* equipped with valves 10*a*, 10*b*, for the discharge towards reservoirs 11*a*, 11*b* of a mixture of expanded propane and impurities precipitated from the polluted oil, whereas at the top of reservoirs 3*a*, 3*b* there is provided a line 12*a*, 12*b*, equipped with valves 13*a*, 13*b* for the eventual return of the vaporized propane to compressor 6, after passing through a temperature exchanger 14.

The mixture of partially purified oil and liquid propane is transferred from reservoirs 3*a*, 3*b*, through a line 15*a*, 15*b*, towards a column 16 where the treatment of the partially purified oil is continued in accordance with the process of the parent patent.

Column 16 is supplied at its upper part, through a line 17, with liquid propane coming from compressor 6, whereas at its base, a mixture of polluted oil and propane is recycled by line 18 towards the reservoirs 3*a* or 3*b*. A mixture of purified oil and propane is discharged from the top part of column 16, through line 19 and flow control valve 30, towards a second column 20 from the top of which is recovered, through line 21, evaporating propane, which is returned to compressor 6 after passing through exchanger 14. At the base of column 20 there is recovered, through line 22, a mixture of propane and purified oil, which is fed to two reservoirs 23*a*, 23*b* where the purified oil, after its complete separation from propane, may be recovered at the drain 24, whereas the propane finishes expanding and is recycled by line 25 to compressor 6.

A propane reserve 26 allows an additional amount to be injected into the circuit through line 27 connected to line 25.

The expanded propane in reservoirs 11*a*, 11*b* is also recycled to compressor 6 by a line 28. The reservoir 11*b* comprises at its base a drain 29 for removal of the impurities eliminated from the used oil in reservoirs 3*a*, 3*b*.

The circuit which has just been described, differs then essentially from that of my U.S. Pat. No. 3,870,625 by the addition, at the head of the apparatus, of reservoirs 3*a* and 3*b* into which the polluted oil is injected by injectors 5*a*, 5*b* and where it is maintained in contact with liquid propane for a period of about one hour. This period is sufficient for the oil and the liquid propane to mix intimately and for the major part of the impurities in the polluted oil to precipitate to the bottom of the reservoir.

The ratio of volume of polluted oil to liquid propane, in reservoirs 3*a* and 3*b*, is between $\frac{1}{4}$ and 1/5, according to the degree of pollution and the nature of the treated oil.

As indicated in my U.S. Pat. No. 3,870,625, in connection with the purification column, it is important that reservoirs 3*a* and 3*b* be subjected to regular vibrations. In the case of small and medium capacity installations, these vibrations may be communicated in a simple manner to the reservoirs and the columns by compressor 6, by disposing the whole of the installation on a carrier structure capable of transmitting to the other elements the vibrations of the compressor.

I claim:

1. A process for regenerating polluted lubricating oil comprising:

charging a reservoir with propane;

injecting polluted lubricating oil into the propane in said reservoir to intimately contact the oil with the propane;

holding the charged propane and injected oil in said reservoir for a time sufficient to permit the oil to dissolve into said propane to form an oil-propane mixture and to permit propane-insoluble impurities to precipitate in said reservoir;

after elapse of said sufficient time, withdrawing said oil-propane mixture from said reservoir, and delivering it into a purifying column;

introducing propane into said purifying column in counter-current flow to said oil-propane mixture to further purify the oil in said mixture;

flowing said oil-propane mixture out of said column and through separating means to separate the propane from the oil by addition of heat;

recovering the separated oil;

recycling the separated propane to said column and to said reservoir; and removing said propane-insoluble precipitated impurities from said reservoir.

2. A process in accordance with claim 1 and further comprising:

delivering said oil-propane mixture from said reservoir into said purifying column at a point low in said column for upward frow therethrough;

introducing said propane into said purifying column at a point high in said column for downward flow counter-current to said oil-propane mixture, whereby impurities precipitated from the oil in the upwardly flowing oil-propane mixture during further purification of said oil are carried downwardly in said column toward the bottom thereof in a polluted oil-propane mixture; and recycling the polluted oil-propane mixture from the base of said column to said reservoir.

3. A process in accordance with claim 1 and further comprising:

passing the oil-propane mixture through at least one additional purifying column prior to said addition of heat.

4. A process in accordance with claim 1 and further comprising:

injecting said polluted-lubricating oil into said reservoir at a plurality of levels thereof to increase the intimacy of contact of said oil and propane.

5. A process in accordance with claim 1 in which the time during which said propane and injected oil are held in said reservoir is about one hour.

6. A process in accordance with claim 1 in which the volume ratio of oil to propane injected and charged to said reservoir is between about ¼ and 1/5.

7. A process in accordance with claim 1 and further comprising:

charging an additional reservoir with propane, injecting polluted-lubricating oil therein holding the oil and propane therein for a time sufficient to permit formation of an additional oil-propane mixture, and delivering said additional oil-propane mixture from said additional reservoir to said purifying column.

* * * * *